US009296398B2

(12) United States Patent
Saxton et al.

(10) Patent No.: US 9,296,398 B2
(45) Date of Patent: Mar. 29, 2016

(54) PROTECTIVE STRUCTURE FOR TOP OF TANK CAR

(71) Applicant: Gunderson LLC, Portland, OR (US)

(72) Inventors: Gregory J. Saxton, Portland, OR (US); Bradley J. Thomas, Beaverton, OR (US)

(73) Assignee: Gunderson LLC, Portland, OR (US)

( * ) Notice: Subject to any disclaimer, the term of this patent is extended or adjusted under 35 U.S.C. 154(b) by 223 days.

(21) Appl. No.: 14/085,669

(22) Filed: Nov. 20, 2013

(65) Prior Publication Data

US 2015/0135986 A1 May 21, 2015

(51) Int. Cl.
*B61D 5/00* (2006.01)
*B65D 90/00* (2006.01)

(52) U.S. Cl.
CPC ..... *B61D 5/08* (2013.01)

(58) Field of Classification Search
CPC ..... B61D 5/00; B61D 5/02; B61D 5/04; B61D 5/06; B61D 5/08
See application file for complete search history.

(56) References Cited

U.S. PATENT DOCUMENTS

| | | | | |
|---|---|---|---|---|
| 3,599,575 | A | 8/1971 | Yurkoski et al. | |
| 4,184,663 | A * | 1/1980 | Rollins | F16K 27/07 105/358 |
| 4,217,830 | A | 8/1980 | Himmelheber, Sr. | |
| 4,220,097 | A * | 9/1980 | Wempe | B61D 5/06 105/360 |
| 4,304,271 | A | 12/1981 | Mowatt-Larssen | |
| 4,527,489 | A * | 7/1985 | Schlink | B61D 5/08 105/358 |
| 4,542,764 | A | 9/1985 | Brittingham et al. | |
| 4,697,528 | A * | 10/1987 | Rehbein | B61D 5/08 105/358 |
| 4,892,042 | A * | 1/1990 | Dalrymple | B61D 5/00 105/362 |
| 5,218,911 | A | 6/1993 | Rehbein et al. | |
| 6,390,119 | B1 | 5/2002 | Crochet et al. | |
| 6,742,550 | B2 | 6/2004 | Caparros | |
| 6,910,427 | B2 | 6/2005 | Woodall et al. | |
| 7,849,801 | B2 * | 12/2010 | Dalrymple | B61D 5/08 105/358 |
| 7,849,802 | B2 * | 12/2010 | Dalrymple | B61D 5/08 105/358 |
| 2014/0261072 | A1 * | 9/2014 | Thompson | G05G 1/08 105/358 |
| 2015/0135986 | A1 * | 5/2015 | Saxton | B61D 5/00 105/358 |

OTHER PUBLICATIONS

Kathi Kube, Rollover Tank Car Test, web posting, Dec. 23, 2009, article appearing on Trains Magazine web site, article downloaded from URL http://trn.trains.com/railroads/2009/12/rollover-tank-car-test on Feb. 12, 2015.

* cited by examiner

*Primary Examiner* — Jason C Smith
(74) *Attorney, Agent, or Firm* — Chernoff, Vilhauer, McClung & Stenzel, LLP

(57) ABSTRACT

A railway tank car including a protective structure for the top of the tank and surrounding a manway or valve mounting nozzle to protect it against damage resulting from the car being overturned even while moving longitudinally. The protective structure may include longitudinally extending generally parallel side plates and a skid structure including longitudinally extending sloping, end portions and providing access to a manway or valve mounting assembly on the top of a nozzle. Openings may be provided in a side wall of the protective structure to give access to valve operating mechanisms extending laterally from valves. A lid for an access opening to a set of valves may include an extension that prevents a valve handle from being moved to open the valve while the lid is closed.

10 Claims, 7 Drawing Sheets

PROTECTIVE STRUCTURE FOR TOP OF TANK CAR

BACKGROUND AND SUMMARY OF THE INVENTION

The present invention is related to railway tank cars and in particular to a protective structure for a manway or a valve-mounting nozzle on the top of a cargo tank of such a railway tank car.

Nozzles have long been provided on the top of a tank car as manways and for mounting valves used to fill a cargo tank with a fluid cargo, to remove the fluid cargo from the cargo tank, and to protect against excessive pressure. It has long been recognized that the nozzles are susceptible to being broken loose and that the valves can be broken in the event of a rollover of a railway tank car. Various protective housings have been designed, including containment caps for preventing loss of cargo in the event of accidents or failure of the valves. Various strengthened and reinforced nozzle structures have been provided in order to resist breakage of the nozzles in the case of a rollover, but previously known protective structures have failed when tank cars have overturned when moving at anything more than a minimal speed. For example, eight miles per hour may be a floor above which a significantly increased amount of protection for nozzles on the top of the cargo tank must be available in order to minimize risk of failure of a nozzle on the top of a cargo tank.

Cargo outlet valves are often provided on the bottom of a railway tank car, and it has been known to provide castings and other structures to surround such outlet valves and protect them in the event of a derailment of a tank car equipped with such a bottom valve. The bottom valves and their associated operating mechanisms, however, are significantly smaller than the manway and valve mounting nozzle structures typically found on the top of a railway tank car. While skid plates or castings have been used to protect the bottom outlet valves on railroad tank car cargo tanks, it had previously been considered unnecessary and an undesirable addition of weight to a railroad tank car to provide any such protective structure surrounding a manway nozzle or a valve group nozzle on the top of a railroad tank car, and, instead, welded gussets and various arrangements of strengthening of the attachment of a nozzle to the top of a cargo tank had been used in the past, as well as bells that can be attached to the valve group mounting plate to protect the valves themselves from damage in collisions and overturning. Known protective structures for a bottom valve do not appear to be able to be modified practically to provide the type of protection needed on the top of a railway tank car. Also, while previous protection for the top of a tank car has value, various events have recently proven that protection to be insufficient in the case of overturning of railroad tank cars in motion along a railroad track at a significant speed.

What is needed, then, is a substantial yet not overly massive structure for protecting the manway and valve mounting nozzles on the top of a cargo tank of a railway tank car, to prevent loss of cargo, and particularly to prevent escape of dangerous gaseous cargo or flammable liquid cargo, in the event of derailment and overturning of a railway tank car moving at a significant speed. Such a protective structure should not be so heavy as to add significantly to the fuel requirements for moving the car along the railway, yet it should be of ample strength. It is desirable also to have a nozzle on the top of a cargo tank be no larger than necessary, in order that it can provide a smaller target which can collide with an obstruction on the ground in the case of a rollover.

In one embodiment of the present invention, a protective structure for the top portion of a railway tank car may include elongate upstanding side members attached to the top of the cargo tank on each lateral side of the nozzles, supporting a skid having opposite end portions sloping upward from the top of the cargo tank to a central portion extending longitudinally above the manway or valve mounting nozzles.

In one embodiment, one or more transverse diaphragms may extend between the side members of the protective structure.

In one embodiment, a central portion of the skid may extend above the top portion of the cargo tank and define an access opening aligned with the nozzle, and there may be a cover plate selectively covering the access opening.

In one embodiment of the protective structure, valve operating mechanisms may extend laterally through openings defined in the side members of the protective structure, and the cover plate for the access opening may include a valve handle retainer to keep the valves on the nozzle in a closed condition.

The foregoing and other objectives, features, and advantages of the invention will be more readily understood upon consideration of the following detailed description of the invention taken in conjunction with the accompanying drawings.

DETAILED DESCRIPTION OF PREFERRED EMBODIMENTS

Figure 2:
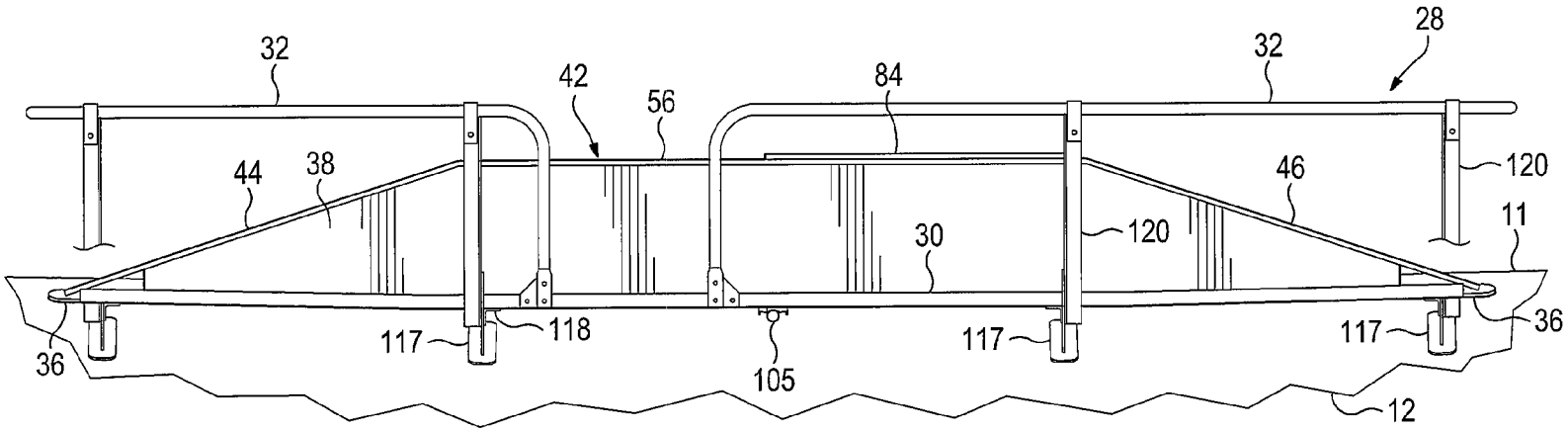
FIG. 2 is a view, at an enlarged scale, of a portion of the tank car shown in FIG. 1 including the protective structure shown in FIG. 1.
Figure 1:
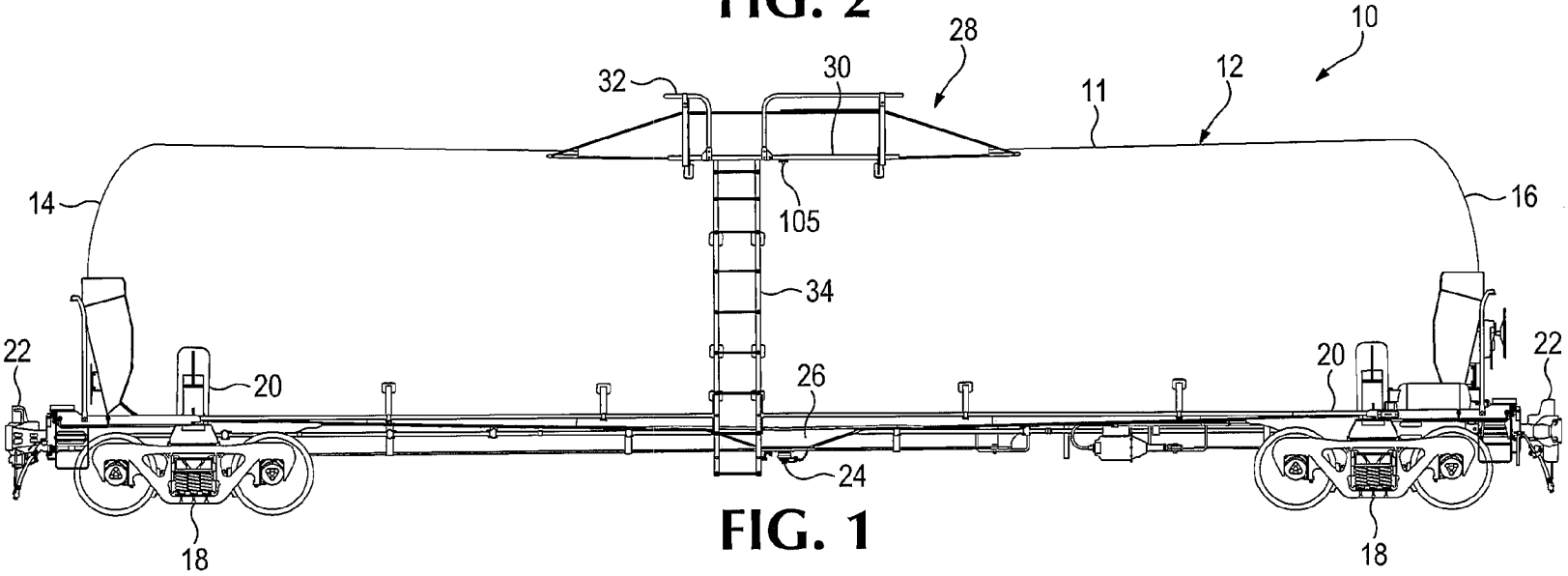
FIG. 1 is a side elevational view of a railway tank car including a protective structure for the top portion of the tank car that is an embodiment of the present invention.
Figure 3:
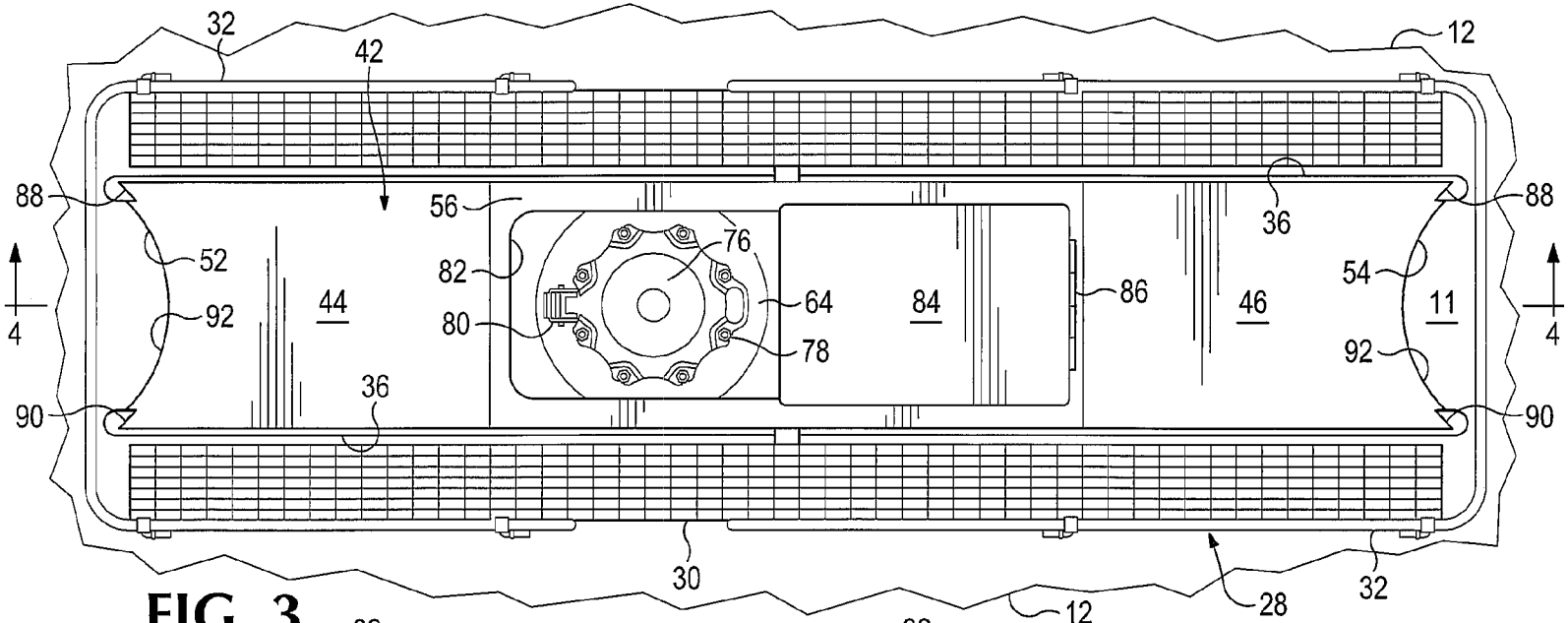
FIG. 3 is a top plan view of the portion of a tank car shown in FIG. 2.

Referring now to the drawings which form a part of the disclosure herein, in FIG. 1 a railroad tank car 10 has a generally cylindrical cargo tank 12 whose opposite ends 14, 16 are supported by a pair of wheeled trucks 18. The wheeled trucks 18 may be attached to the cargo tank by appropriate conventional saddles and bolsters 20 connected with an outer surface of the cargo tank 12, but the cargo tank itself is constructed in most such railroad tank cars with significant enough rigidity and strength not only to be self supporting, but to bear the longitudinal train loads exerted on the tank car 10 during travel. A conventional double shelf coupler 22 may be provided at each end of the car. Centrally located in the bottom of the cargo tank there may be a bottom outlet valve 24 and related valve operating mechanisms associated with which there may be conventional protective structures 26.

Also located about mid-length of the car 10 and centrally along the top of its cargo tank 12 is a protective structure 28. There may also be a walkway 30 and a suitable hand rail 32 alongside the protective structure, as well as a ladder 34 leading along the outside of the cargo tank toward the bottom of the car.

As shown at an enlarged scale in FIGS. 2, 3, 4, and 5, the protective structure 28 may be attached to a pair of elongate mounting pads 36, or rails, welded to an outer surface of the cargo tank 12. The mounting pads 36 may extend longitudinally along the top of the cargo tank 12 equidistant from the longitudinal centerline of the top of the cargo tank 12 and parallel with each other. The pads may, for example, be of steel about three to five inches wide and may have a thickness of about 0.5 inch.

A pair of side members such as generally trapezoidal side plates 38 and 40 extend upward from the mounting pads 36, with each side plate 38, 40 welded to a respective one of the pads 36. The side plates 38 and 40 may extend generally vertically and may be parallel with each other. The side plates 38 and 40, to save weight, may be of high-strength steel, such as type AAR TC-128 Gr. B normalized steel, or they may be of ASTM A 572 grade 50 steel of 0.75 inch thickness.

A skid structure 42 may have a pair of inclined opposite end portions 44 and 46 extending along and welded to the inclined upper margins 48 and 50 of the side plates 38 and 40, at each of a pair of opposite ends 52 and 54 of the top protective structure 28. The inclined end portions of the skid structure 42 may have a slope of, for example, 3:1, although slopes in the range of 2:1 to 4:1 could also be used.

A central portion 56 of the skid structure may be generally horizontal and extends between the upper, inner, ends of the end portions 44 and 46, a small distance 58 above the top of the highest one of a group of valves.

The top 11 of the cargo tank 12 may, as is conventional, be equipped with one or two nozzles 60 and 62, each connected with and extending upward from an opening through the upper portion of the cargo tank wall. The cargo tank wall may be suitably reinforced around each nozzle opening, as by an annular doubler 64, 66 of suitable strength extending radially outward from the respective nozzle 60 or 62. The nozzle 60 is provided with a closure member such as a valve mounting plate 68 on which at least two valves may be mounted. For example, there may be a cargo delivery and removal valve 70, a pressurized fluid admission valve 72, and a pressure relief safety valve 74. For example, a three-inch diameter valve 70 may be used in a fill pipe that extends nearly to the bottom of the cargo tank 12 to deliver cargo into the tank, and that may be used for a suction line to remove cargo from a sump in the bottom of the cargo tank 12. A two-inch diameter valve 72 may be used for introduction of pressurized air, for example. Typically, the pressure relief safety valve 74 extends to the greatest height above the mounting plate 68.

The other nozzle 62 may be a manway provided with a closure member, such as a manway cover 76, attached by suitable fasteners such as pivoted eyebolts 78 and nuts. The cover 76 may be connected with the nozzle 62 by a hinge 80, permitting the cover 76 to be opened from the manway to provide access for personnel to inspect or repair the interior of the cargo tank 12.

A central opening 82 may be defined in the central portion of the skid structure 42 as shown in FIGS. 2, 3, 5, and 7, to provide for convenient access to the valves 70, 72, and 74, and the manway nozzle 62 atop the cargo tank 12.

A lid 84, of heavy sheet metal, for example, may be provided to cover a portion of the central opening 82, at least over the valve grouping and the nozzle 60 to which it is attached. The cover plate 84 may be attached, for example, by a suitable hinge 86 near one of the ends of the central portion 56 of the skid structure 42.

Each end of the skid structure 42 may be notched as at 88 and 90, to permit the corners of the inclined end portions 44 and 46 to be welded to the elongate mounting pads 36. The concave arcuate ends 92 of the inclined portions 44 and 46 may be close to the outer surface of the cargo tank, but preferably are not touching to it. The skid structure 42 may be a single piece of steel plate bent appropriately at the each end 94 of each of the central portion 56.

Figure 4:
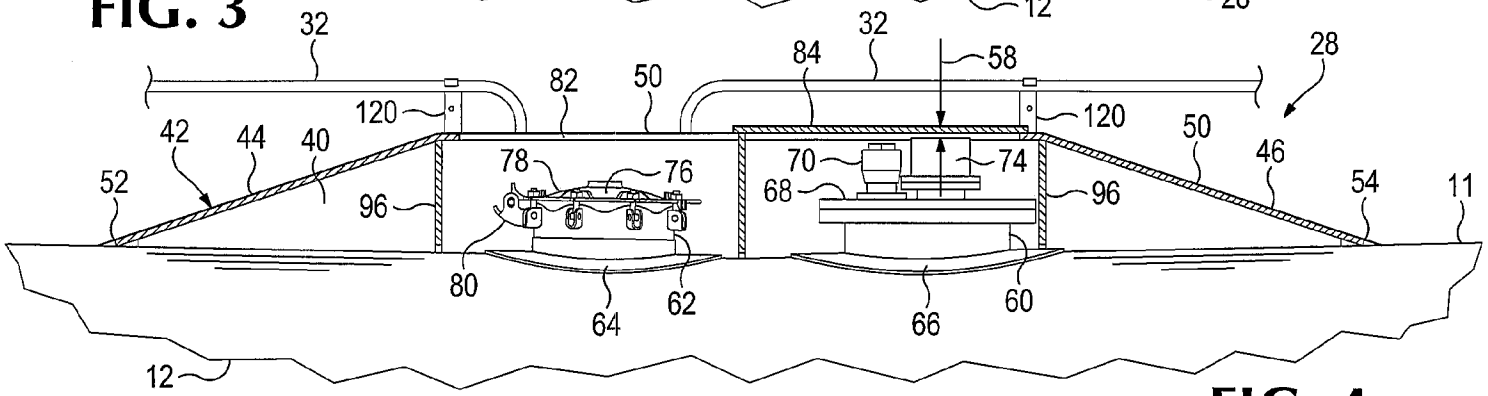
FIG. 4 is a sectional view taken along the line 4-4 in FIG. 3
Figures 5, 6:
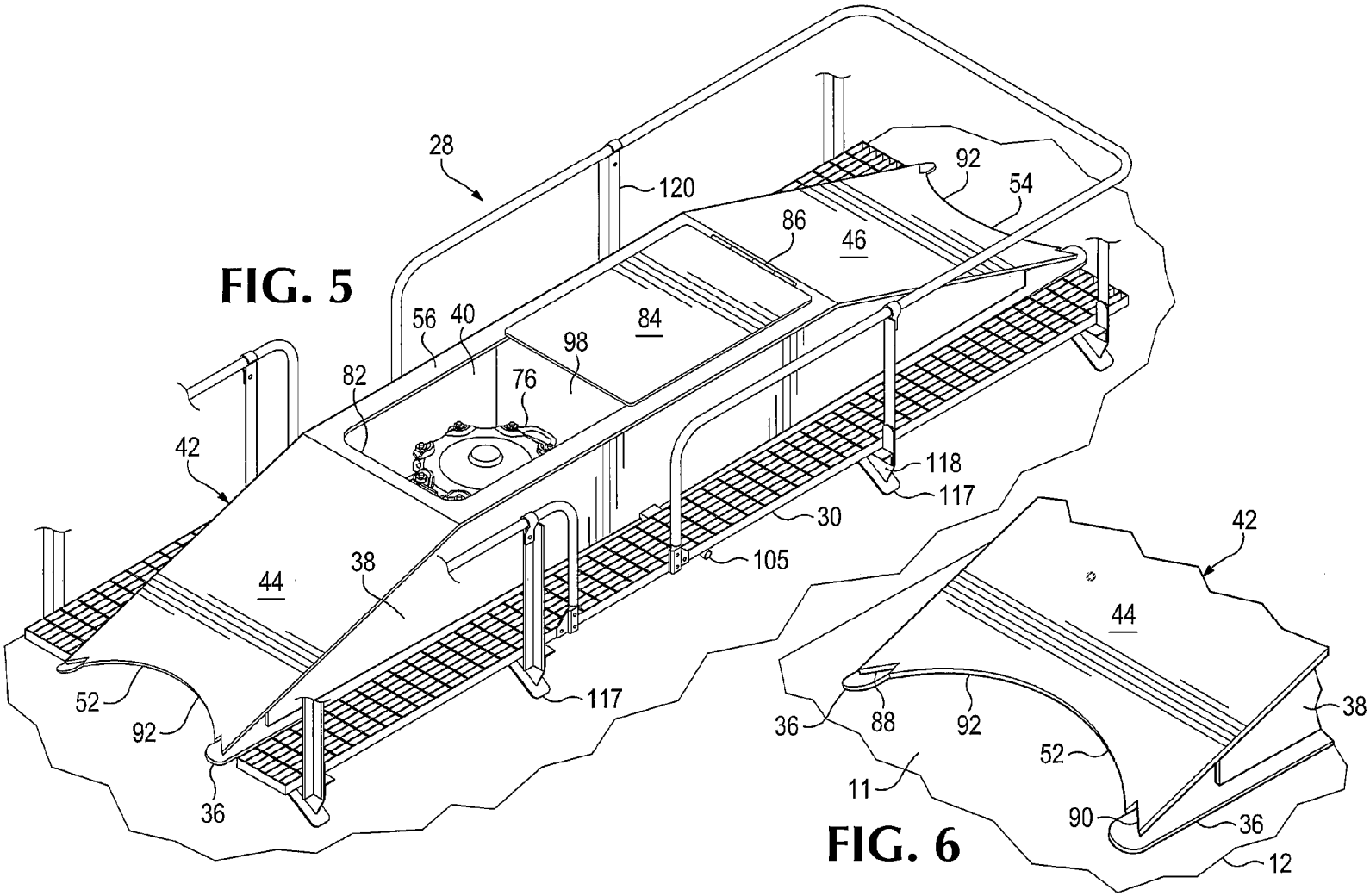
FIG. 5 is an isometric view taken from the left of the protective structure shown in FIGS. 2 and 3.
FIG. 6 is an isometric detail view, at an enlarged scale, showing an end of the protective structure shown in FIGS. 2, 3, 4, and 5.

As shown best in FIGS. 4 and 5, upstanding transverse diaphragms 96 may extend between the side plates 38, 40 at each end 94 of the central portion 56. These diaphragms 96 may be welded to the side plates 38, 40 and to the underside of the skid 42. An additional upstanding transverse central diaphragm 98 may be located between the two nozzles 60, 62 and extend between the side plates 38, 40. This central diaphragm 98 may be notched and welded to the underside of the central portion 56 of the skid structure 42 on each side of the central opening 82, with an upper margin 100 extending transversely and coplanar with upper surface of the central portion 56 of the skid structure 42, as may be seen in FIGS. 4 and 7, so that the upper margin 100 can assist in supporting the cover plate 84.

The skid structure 42 may also, as the side plates, be of a suitable relatively high-strength steel such as, for example, A572 group 50 plate 0.75 inch thick, although a higher strength steel or greater thickness may be determined by engineering calculations to be better able to withstand potential forces, depending on the designed size and capacity of the tank car 10.

The security of the weld attachment of each of the mounting pads 36 to the outer surface of the cargo tank 12 is preferably enough (at least fifteen percent) stronger than the attachment of each of the side plates to the respective mounting pad that the side plates 38, 40 can be reliably torn apart from the mounting pads 36 without tearing the pads 36 apart from the cargo tank 12 in the event of the railcar 10 being overturned while traveling at a significant speed.

The inclined end portions 44 and 46 of the skid structure 42 are intended to greatly increase the likelihood that, should the tank car 10 be overturned while moving at a significant speed, the cargo tank 12 would be able to skid along the ground or a railroad track, without the manway and valve mounting nozzles 60 and 62 colliding into an obstruction in the vicinity of the derailment with sufficient force to result in a failure of the nozzle 60 or 62 or of the valve mounting plate 68.

Figures 7, 7A, 7B:
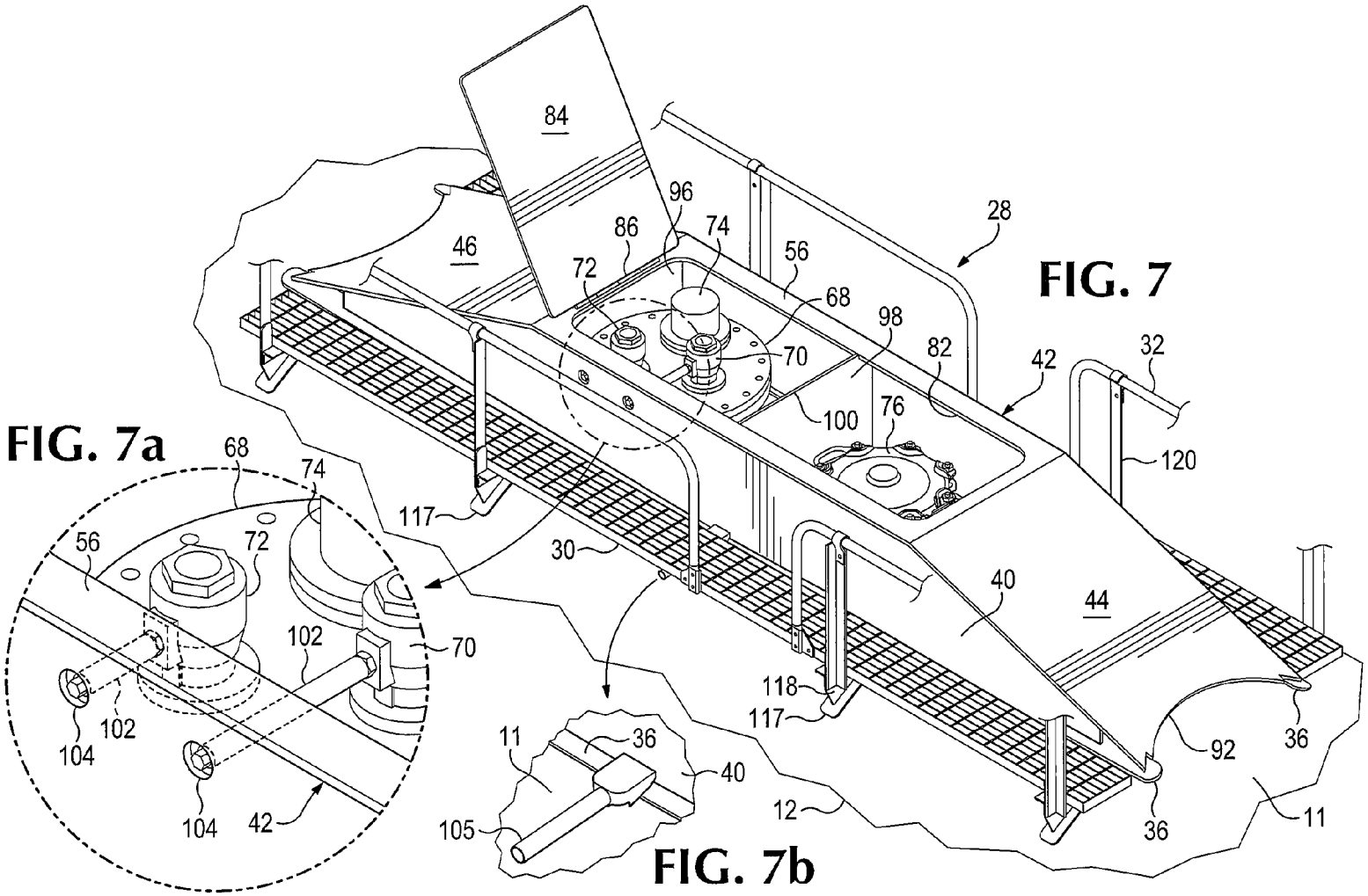
FIG. 7 is an isometric view taken from above the far side of the left end of the protective structure shown in FIG. 3.
FIGS. 7*a* and 7*b* are views of hidden details of FIG. 7, at an enlarged scale.

As shown in FIG. 7, the lid 84 may be raised to provide access to the valves 70, 72, and 74 for maintenance and connection of suitable conduits for delivering cargo into, or for removal of cargo from the interior of the cargo tank 12, and for providing fluid such as a suitable gas under pressure into the cargo tank to assist in urging cargo out of through the bottom outlet valve 24.

In one embodiment, the valves 70 and 72 may, for example, be operated by suitable mechanisms such as a shaft 102 extending horizontally from each valve toward a suitable opening 104 provided in one of the side plates 38 and 40, as shown enlarged in FIG. 7*a*. Each of the openings 104 may permit an end of the respective valve-operating shaft 102 to be engaged by a suitable wrench, or a specialized operating handle. Such an operating handle may have a key portion, for example, a radially-extending portion such as a rib or tang, and each of the openings 104 in the side plate may be of a corresponding key-hole shape, to permit the valve-operating handle to be inserted through the opening 104 to fit drivingly on the respective valve operating shaft 102 only when the associated valve is in a closed position, as a safety provision to ensure that the railroad tank car 10 is not moved before the valves 70 and 72 have been fully closed, and thus to avoid leakage of fluid cargo, such as petroleum products or chemical gases. This may permit the valves 70, 72, and 74 to be lower in height and closer together than previous valve groups, so that the nozzle 60 can be smaller in diameter and height than previous such nozzles.

The height of the manway nozzle 62 is made lower than that of the highest valve, the safety valve 74, to minimize the height of the top protective structure 28.

While it has been customary to utilize a manway nozzle 62 and a valve group nozzle 60 spaced apart longitudinally of a railway tank car by a distance great enough to provide for by a person to pass conveniently between the nozzles, using the protective structure 28 disclosed herein with laterally extending valve operating shafts 102 the nozzles 60 and 62 may be placed closer together on the cargo tank 12, with a spacing of, for example, 18 inches between the nozzles 60 and 62.

The hinged lid 84 provides protection of the valves on the mounting plate 68 from the weather and from easy tampering and may be secured in a manner by which any tampering is clearly evident, such as by a hasp and padlock arrangement (not shown) connecting the lid 84 to the center diaphragm 96, with an accompanying tamper-evident seal.

The cargo tanks 12 of tank cars 10 intended to carry cargo such as crude oil may be jacketed with a layer of a thermal insulation, and drainage, as by provision of a drain spout 105 shown best in FIG. 7*b*, is required from the vicinity of a manway 62 or valve group nozzle 60 to protect the insulating jacket from being damaged by accumulated water or commodity spillage.

Figure 8:
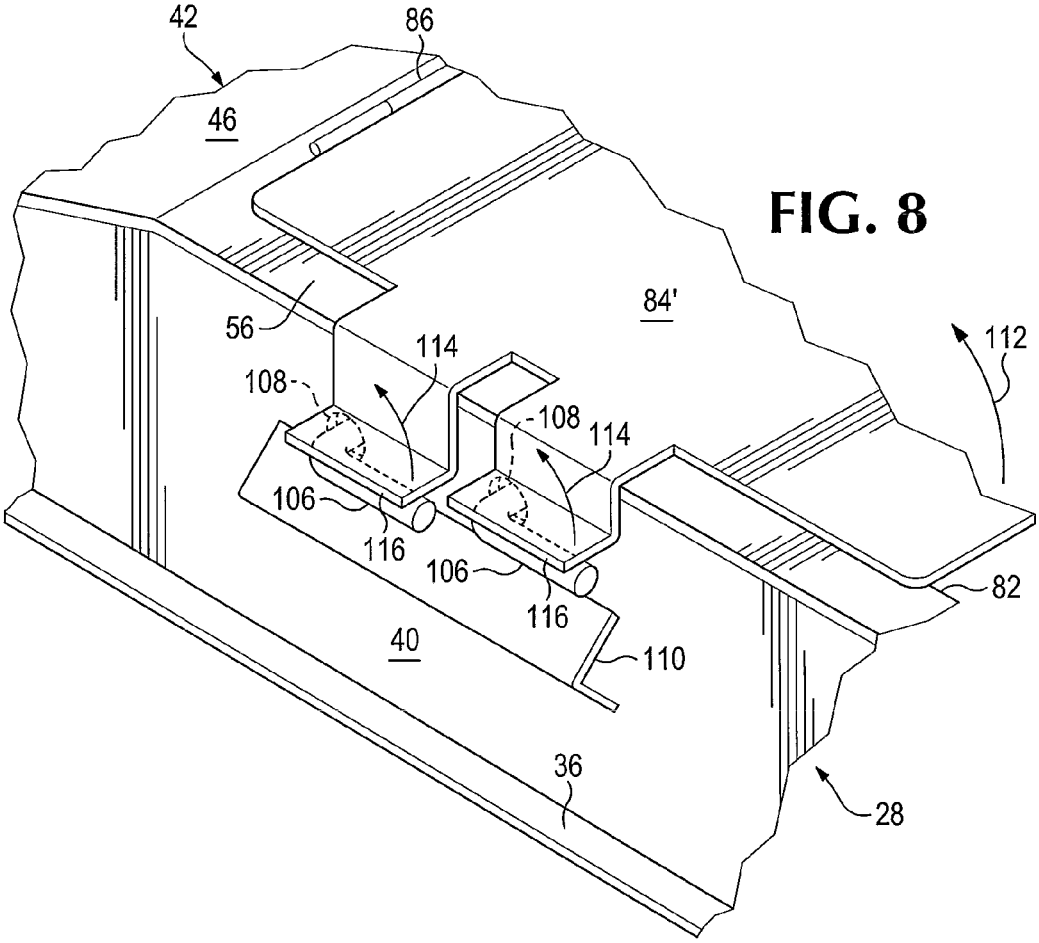
FIG. 8 is an isometric view, taken in the same direction as and at a scale similar to FIG. 7, showing an alternative embodiment of the protective structure.

Referring to FIG. 8, instead of the arrangement shown in FIG. 7, providing for insertion of a removable valve-operating handle, permanently installed valve operating handles 106 may extend out through openings 108 in one of the side plates. A valve handle guard 110, for example a length of angle iron welded to the respective side plate 38 beneath the valve operating handles 106, may be provided to shield them from inadvertent impact under ordinary circumstances.

A lid 84' is shown in a closed position in FIG. 8, but when it is opened in the direction indicated by the arrow 112, the valve handles 106 are free to be rotated in the direction indicated by the arrows 114. In order for the lid 84' to be closed and fastened in a closed condition, however, the valve handles 106 must be rotated in the direction opposite the arrows 114 to close the valves, and once the valves 70 and 72 are closed, with the valve handles 106 in the position shown in FIG. 8, the valve handle retainers 116 prevent the valve operating handles 106 from being turned in the direction of the arrows 114, and thus keep the valves 70, 72 closed and insure that the valves are closed when the railroad tank car 10 is in motion.

The walkway 30 on each side of the tank car top protective structure 28 may be attached to the exterior of the cargo tank 12 in conventional ways such as through mounting pads 117 welded to the exterior surface of the cargo tank 12 to receive walkway support members 118 and support handrail stanchions 120. A handrail 32 may have an opening aligned with the ladder 34 on at least one side of the tank car 10.

The combination of the side plates 38 and 40, the diaphragms 96 and 98, and the skid structure 42, with its inclined end portions and horizontal central portion, offers protection for the manway 62 and valve group nozzle 60 of a railroad tank car 10 that has overturned. Even though the top protective structure 42 itself may be severely damaged or torn free from the top of the cargo tank 12, it offers significant protection against damage to the manway and valve group nozzles 60 and 62, to prevent loss of significant amounts of fluid cargo from the cargo tank.

While the skid structure 42 is shown in the drawings as having inclined end portions 44 and 46 and a flat horizontal central portion 56 of flat plate construction, it will be understood that the end portions 44, 46 and central portion 56 need not be flat but might be of a convex and frustoconical, cylindrical, prismatic or pyramidal shape. Any of these could still be effective so long as the end portions are inclined with respect to the general line of the top of the cargo tank 12 as seen in FIG. 1, so as to act as a wedge or ramp to support the central portion of the cargo tank and protect the nozzles 60 and 62, and the valves 70, 72, and 74, should the tank car 10 be overturned while moving in a longitudinal direction at a significant speed.

Figure 9:
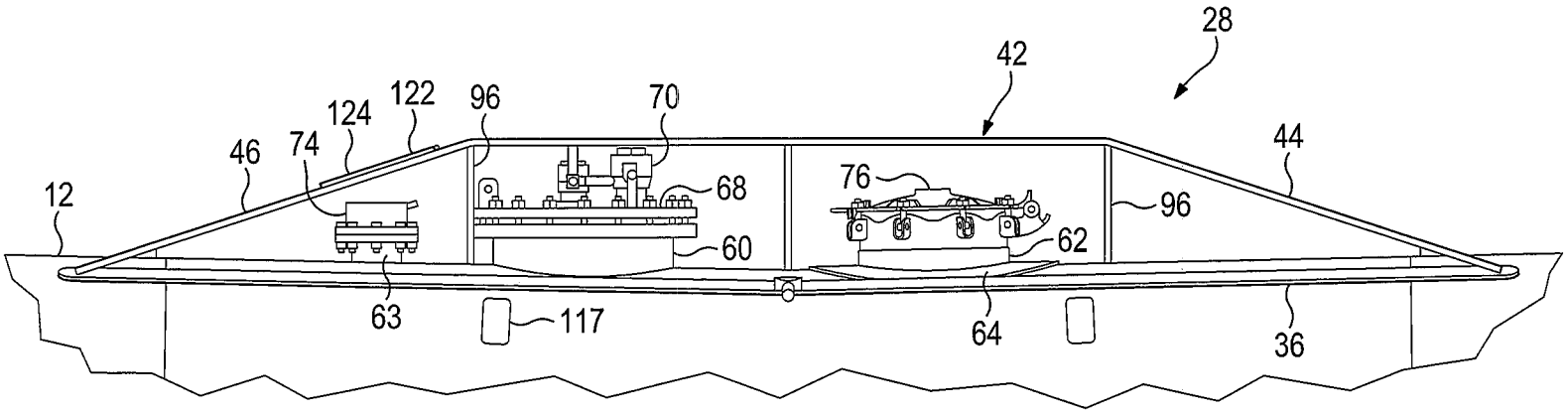
FIG. 9 is a view similar to FIG. 4, showing a protective structure on a tank car in which a pressure relief valve is located separately from a valve nozzle for cargo valves, but not showing related walkways or railings.
Figure 10:
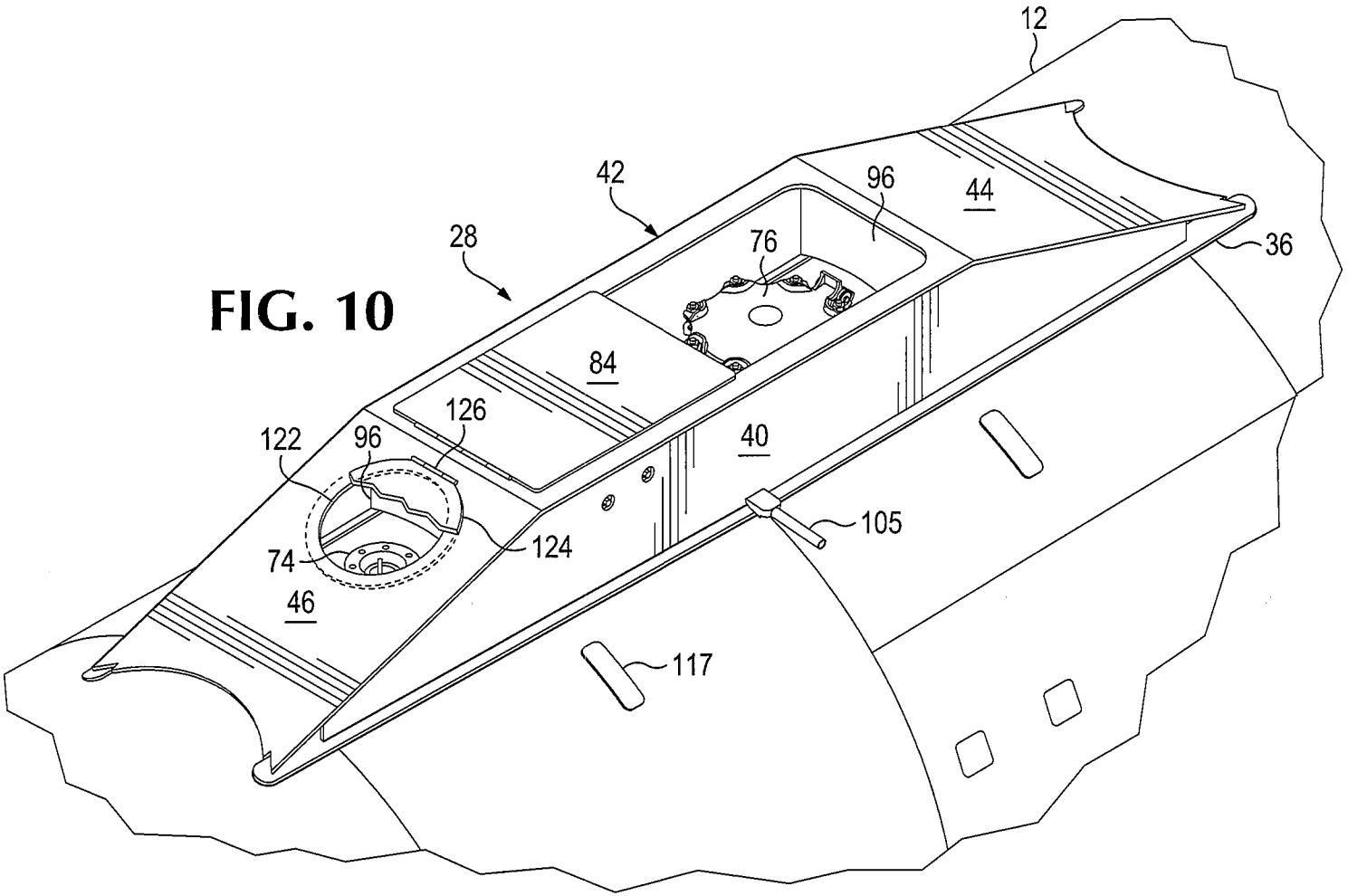
FIG. 10 is an isometric view taken from the left of the protective structure shown in FIG. 9.

As shown in FIGS. 9 and 10, a pressure relief safety valve 74 may be located at a location along the top of the cargo tank 12 longitudinally separate from the nozzle 60 on which the valve mounting plate 68 may be mounted as shown in FIGS. 5 and 7. Thus, the pressure relief safety valve 74 may be mounted at its own piercing through and nozzle 63 on the top of the tank, in a location beneath the sloping end portion 46 of the skid structure 42. A pressure relief opening 122 may be cut in the sloping portion 46 of the protective skid structure 42 as a path for discharge from the pressure relief safety valve.

A suitable lid 124, which, like the lid 84, may be of appropriately thick sheet metal, may be attached to the end portion 46 of the skid structure 42 by suitable hinges 126, leaving the lid 124 free to be raised without particular difficulty in the case of attention to the pressure relief safety valve 74 being necessary, or in the event of contents of the tank being released through the safety valve 74. The lid 124 can normally cover the hole in the sloping portion of the skid structure 42 to protect the pressure relief safety valve 74 from the weather.

The lid 124 may be attached to the sloping portion 46 of the skid structure 42 by other means, such as tabs on the lid 124 fitting into corresponding slots in the sloping portion 46, so long as it is still possible for the lid 124 to be opened without undue difficulty.

In a car where the pressure relief safety valve 74 is separately located as shown in FIG. 9, the nozzles 60 and 62 may be shorter in height than when the pressure relief safety valve is conventionally mounted on the vale mounting plate. It may be then practical for the protective skid structure 42 also to be lower and closer to the top of the cargo tank 12, thus providing ample protection for the nozzles 60 and 62 and the pressure relief safety valve 74 while adding a minimum of weight in the protective skid structure 42 to the weight of the tank car.

The terms and expressions that have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A railroad tank car comprising:

(a) a cargo tank for containing fluid cargo and having an elongate generally cylindrical configuration including a horizontal central axis, a pair of opposite ends, and a top;

(b) an opening defined in the top of the tank;

(c) a nozzle extending from the opening and having a portion located above the top of the cargo tank;

(d) a closure member associated with the nozzle;

(e) a protective structure attached to the top of the tank, the protective structure at least partially enclosing the nozzle and the closure member, the protective structure including a pair of laterally-separated side plates located on opposite lateral sides of the opening and a skid structure supported by and extending laterally between the side plates, the skid structure extending longitudinally of the railcar and including an upwardly-inclined end portion extending longitudinally of the railcar on a sloping angle, from a location adjacent the top of the tank and spaced longitudinally apart from the opening, to an uppermost part of the skid structure;

(f) a central portion of the protective structure extending longitudinally and located above the closure member;

(g) a transversely-oriented reinforcing diaphragm interconnecting the side plates with each other; and (h) an access opening defined through the central portion of the skid structure in a location aligned with the closure member, and wherein at least one of the side plates defines an opening aligned with a valve operating mechanism, the opening having a shape admitting introduction of a valve-operating handle so as to mate with the valve operating mechanism only when the valve operating mechanism is in a predetermined position.

2. The railroad car of claim 1 including a pair of elongate mounting pads attached to the cargo tank, the side plates each being attached to and extending along a respective one of the mounting pads.

3. The railroad car of claim 1 wherein the end portion of the skid structure is a plate welded to the diaphragm and to the side plates.

4. The railroad car of claim 1 wherein the closure member is a valve mounting plate.

5. The railroad car of claim 1 including a lid movably attached to the central portion of the protective structure and covering at least a portion of the access opening in the central portion and wherein the lid includes an extension aligned with the opening defined in the side plate so as to hold a valve-operating handle in a predetermined position when the lid is in a closed position.

6. A railroad tank car comprising:

(a) a cargo tank for containing fluid cargo and having an elongate generally cylindrical configuration including a horizontal central axis, a pair of opposite ends, and a top;

(b) an opening defined in the top of the tank;

(c) a nozzle extending from the opening and having a portion located above the top of the cargo tank;

(d) a closure member associated with the nozzle;

(e) a protective structure attached to the top of the tank, the protective structure at least partially enclosing the nozzle and the closure member, the protective structure including a pair of laterally-separated side plates located on opposite lateral sides of the opening and a skid structure supported by and extending laterally between the side plates, the skid structure extending longitudinally of the railcar and including an upwardly-inclined end portion extending longitudinally of the railcar on a sloping angle, from a location adjacent the top of the tank and spaced longitudinally apart from the opening, to an uppermost part of the skid structure;

(f) central portion of the protective structure extending longitudinally and located above the closure member;

(g) a transversely-oriented reinforcing diaphragm interconnecting the side plates with each other;

(h) an access opening defined through the central portion of the skid structure in a location aligned with the closure member;

(i) wherein at least one of the side plates defines an opening aligned with a valve operating mechanism; and (j) a lid movably attached to the central portion of the skid structure and covering at least a portion of the access opening in the central portion, and wherein the lid includes an extension aligned with the opening in the side plate so as to hold a valve operating handle in a predetermined position when the lid is in a closed position.

7. A railroad tank car comprising:

(a) a cargo tank for containing fluid cargo and having an elongate generally cylindrical configuration including a horizontal central axis, a pair of opposite ends, and a top;

(b) an opening defined in the top of the tank;

(c) a nozzle extending from the opening and having a portion located above the top of the cargo tank (d) a closure member associated with the nozzle;

(e) a protective structure attached to the top of the tank, the protective structure at least partially enclosing the nozzle and the closure member, the protective structure including a pair of laterally-separated side plates located on opposite lateral sides of the opening and a skid structure supported by and extending laterally between the side plates, the skid structure extending longitudinally of the railcar and including an upwardly-inclined end portion extending longitudinally of the railcar on a sloping angle, from a location adjacent the top of the tank and spaced longitudinally apart from the opening, to an uppermost part of the skid structure;

(f) a central portion of the protective structure extending longitudinally and located above the closure member;

(g) a transversely-oriented reinforcing diaphragm interconnecting the side plates with each other; and (h) an access opening defined through the central portion of the skid structure in a location aligned with the closure member; and wherein a pressure relief safety valve is located on the top of the tank at a location longitudinally spaced apart from the opening defined in the top of the tank, the upwardly-inclined end portion of the protective structure at least partially surrounding the pressure relief safety valve.

8. The railroad car of claim 7 wherein the opening in the top of the tank is a manway.

9. The railroad car of claim 7 including a pair of elongate mounting pads attached to the cargo tank, the side plates each being attached to and extending along a respective one of the mounting pads.

10. A railroad tank car comprising:

(a) a cargo tank for containing fluid cargo and having an elongate generally cylindrical configuration including a horizontal central axis, a pair of opposite ends, and a top;

(b) an opening defined in the top of the tank;

(c) a nozzle extending from the opening and having a portion located above the top of the cargo tank;

(d) a closure member associated with the nozzle;

(e) a protective structure attached to the top of the tank, the protective structure at least partially enclosing the nozzle and the closure member, the protective structure including a pair of laterally-separated side plates located on opposite lateral sides of the opening and a skid structure supported by and extending laterally between the side plates, the skid structure extending longitudinally of the railcar and including an upwardly-inclined end portion extending longitudinally of the railcar on a sloping angle, from a location adjacent the top of the tank and spaced longitudinally apart from the opening, to an uppermost part of the skid structure;

(f) a central portion of the protective structure extending longitudinally and located above the closure member;

(g) a transversely-oriented reinforcing diaphragm interconnecting the side plates with each other;

(h) an access opening defined through the central portion of the skid structure in a location aligned with the closure member; and (i) a pressure relief safety valve located on the top of the tank at a location longitudinally spaced apart from the opening defined in the top of the tank, the upwardly-inclined end portion of the protective structure defining a pressure relief opening above the pressure relief safety valve.

* * * * *